US005678696A

United States Patent [19]

Goetz

[11] Patent Number: 5,678,696

[45] Date of Patent: Oct. 21, 1997

[54] ALUMINUM CAN RECYCLING

[76] Inventor: Joseph R. Goetz, 550 E. Encinas Ave., Gilbert, Ariz. 85234

[21] Appl. No.: 532,471

[22] Filed: Sep. 22, 1995

[51] Int. Cl.[6] ..... B07C 5/00

[52] U.S. Cl. ..... 209/44.2; 209/636; 209/644; 209/522; 209/215; 194/209; 194/213

[58] Field of Search ..... 209/39, 636, 644, 209/522, 215, 223.1, 930, 44.2; 194/209, 211–213, 219, 320

[56] References Cited

U.S. PATENT DOCUMENTS 3,749,240 7/1973 Spears et al. ..... 209/636 C 4,440,284 4/1984 DeWoolfson ..... 194/213

4,967,912 11/1990 Schonberg ..... 209/636

5,355,987 10/1994 DeWoolfson et al. ..... 194/209

*Primary Examiner*—David H. Bollinger

[57] ABSTRACT

A compact aluminum can separator have a a continuous conveyer belt, means mounting the conveyer belt to have an upper layer and a lower layer and for revolving said belt to cause the upper layer to travel generally horizontally from an input end of the separator to an output end of the separator and means for positioning cans and bottles on the belt proximate the input end of the separator an a forced air-magnet separator for separating aluminum from steel cans is disclosed.

9 Claims, 1 Drawing Sheet

ALUMINUM CAN RECYCLING

FIELD OF THE INVENTION

This invention is an ecologically and economically efficient system for separating aluminum cans from bottles, steel cans, etc.

BACKGROUND OF THE INVENTION

Recycling of aluminum cans is a major source of aluminum for aluminum foundries, etc., and a major industry. One of the very important sources of aluminum is the recycling of soft drink and beer cans by consumers.

Many types of systems and devices are described in the. patent and industrial literature for separating aluminum cans and other aluminum articles from ferrous metals, bottles, etc. Most of these devices are very large and are adapted for use only in recycling yards for processing tons of material per day.

Americans and people around the world are becoming increasingly aware of the need to recycle their waste products. Aluminum cans have significant economic value and many people sell their own used cans and collect cans from others for sale to recycling yards. Efforts have been made to provide recycling facilities in convenient locations, such as super markets and other places frequented by consumers.

Even though consumer recycling did not become popular until about two decades ago, the overall concepts of the technology have been thoroughly developed and many systems and devices have been designed to collect recycled products, separate the products, etc. Indeed, this is a crowded art.

Notwithstanding the many approaches to consumer recycling stations, there remains a great need for a simple, reliable and inexpensive system for receiving recycled aluminum cans, steel cans and glass or plastic bottles and for separating the aluminum, which alone has significant sale value, and for compensating consumers for their aluminum cans.

This invention is directed to solving the problems of collection, separation and compensation for consumer recycled aluminum cans.

SUMMARY OF THE INVENTION

A system for recycling and separating consumer aluminum cans is disclosed. The system has a receptacle for receiving cans, a continuous conveyer belt and means mounting the conveyer belt to have an upper layer and a lower layer and for revolving said belt to cause the upper layer to travel generally horizontally from an input end of the separator to an output end of the separator and for mounting the conveyer belt to orient the belt from side-to-side at an angle of from about 5 degrees to about 20 degrees from horizontal. Means are provided for means for positioning cans and bottles on the belt proximate the input end of the separator. Forced air means having an outlet constructed and configured to cause a high velocity stream of air to move above the belt from side to side of the belt transfers to the length of the conveyer belt for blowing aluminum cans from the belt. Magnets positioned adjacent the belt proximate the forced air means prevent steel cans from being blown from the belt. The belt, mounting means and forced air means are constructed and configured to cause cans on the belt to move sideways on the belt toward source to cause the cans to be carried closely proximate the air flow source outlet. Optionally, the system may include means for generating an electrical signal in response to each aluminum can deposited in the receptacle and means for receiving said signal for dispensing coins or certificates or coupons to the consumer in response to the number of aluminum cans deposited.

A compact aluminum can separator have a continuous conveyer belt, means mounting the conveyer belt to have an upper layer and a lower layer and for revolving said belt to cause the upper layer to travel generally horizontally from an input end of the separator to an output end of the separator and means for positioning cans and bottles on the belt proximate the input end of the separator. Forced air means constructed and configured to cause a high velocity stream of air to move above the belt from side to side of the belt transfers to the length of the conveyer belt for blowing aluminum cans from the belt and magnets positioned adjacent the belt proximate the forced air means for preventing steel cans from being blown from the belt effect the separation of aluminum from steel cans.

DESCRIPTION OF THE PREFERRED EMBODIMENT

The following discussion discloses a preferred form of the invention. It is to be remembered that the device is made up of common, usually "off-the-shelf" components and, therefore, many variations and substitutions can be made without departing from the spirit and scope of the invention.

Figure 1:
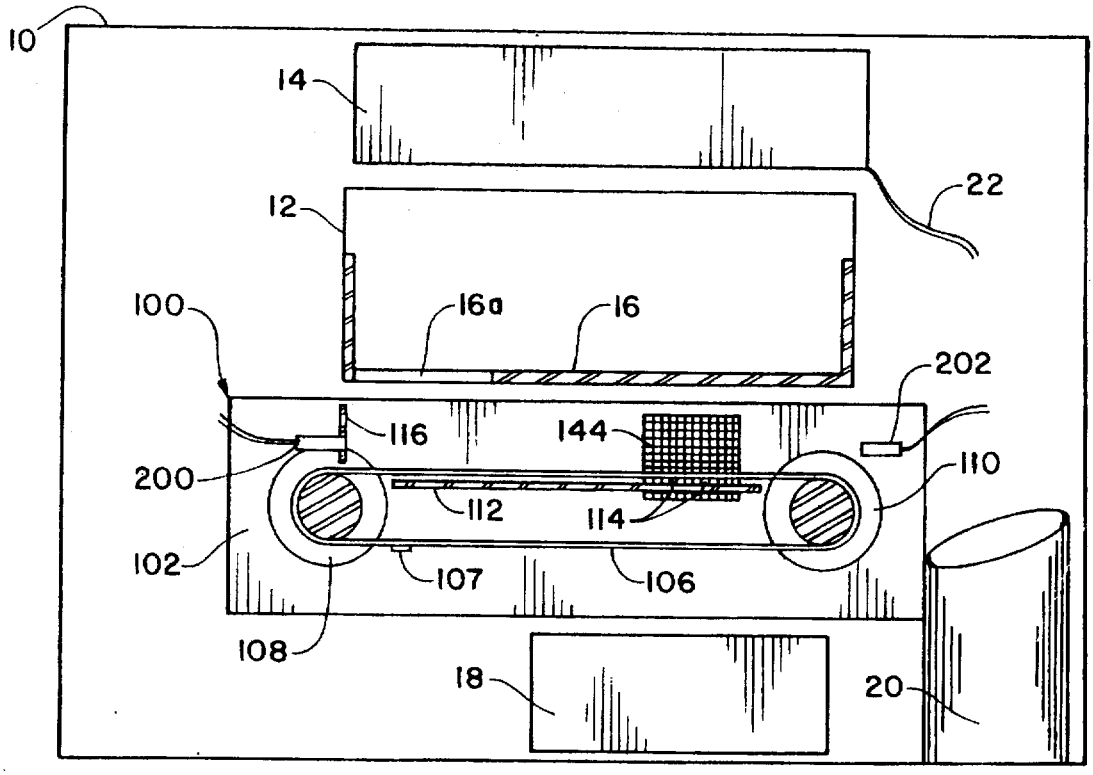
FIG. 1 is a schematic depiction of a consumer recycling station depicting the separator device in an elevational partial cross sectional view, take substantially along lines 1—1 of FIG. 2.
Figure 2:
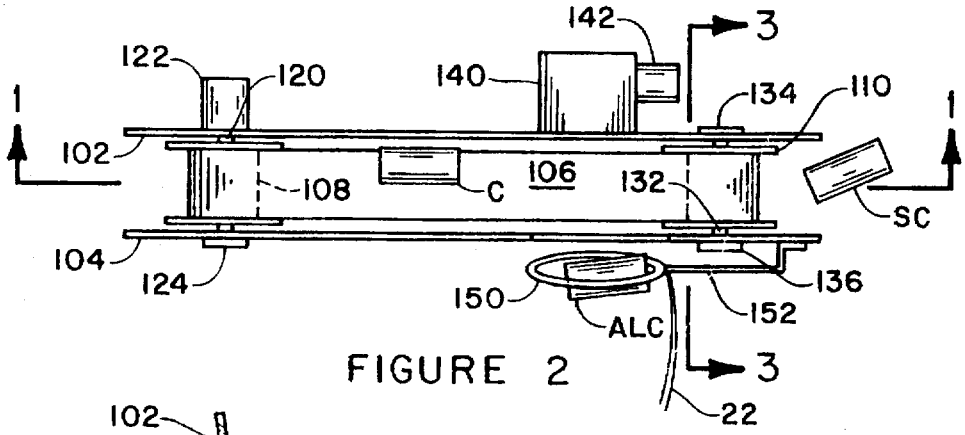
FIG. 2 is a top plan view of the separator of this invention showing the mode of operation thereof, the starter means being omitted for clarity of illustration..

Referring first to FIGS. 1 and 2, one form of an overall system contemplated by this invention is a complete recycling station shown inside an enclosure 10 that has an opening 12 into which the consumer can place cans and bottles. A display and computer assembly 14 is provided for immediately compensating the consumer for aluminum cans. A guiding receptacle 16 is mounted over the opening 12 to assist the consumer in depositing cans, etc. The guiding receptacle is provided with a passage **16*a* of a size to accept standard individual drink size aluminum cans and too small to accept larger cans. A receptacle for aluminum cans 18 and a receptacle for bottles, steel cans, etc. 20** are conveniently provided. In practice, these receptacles may feed to a crusher or to a conveyer to carry the aluminum cans and, respectively, the bottles and steel cans to storage facility. The computer assembly is connected by electrical conduits to an aluminum can counter to be described. Any of a virtually infinite number of computers or calculating devices may be used to provide direct compensation to the consumer based on the number of aluminum cans deposited.

Figure 3:
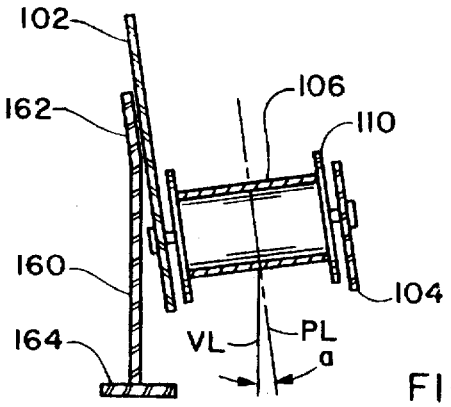
FIG. 3 is a vertical cross sectional view of one end of the separator device showing one of the very important structural features thereof, taken substantially along lines 3—3 in FIG. 3, the starter means being omitted for clarity of illustration.

An important part of the present invention is a small, highly efficient and reliable aluminum can separator 100, shown in FIGS. 1, 2 and 3. The aluminum can separator 100 comprises a pair of parallel side plates 102 and 104 which may be secured in spaced relation in any manner, and which provide support for an endless belt 106 which is received on a pair of pulleys 108 and 110 which are, respectively, mounted for rotation in the plates 102 and 104 directly by journals or by bearings. In FIGS. 2 and 3, the input end of the separator is shown on the left side of the drawing.

The continuous belt 106 that is on top preferably rides above a cross-beam 112 that positions the two sides 102 and 104 in spaced parallel relationship. One or more magnets, either permanent magnets or electric magnets, 114 are position under the upper portion of continuous belt proximate the output end, the right end as shown in FIG. 1. A plate 116 is mounted above the belt proximate the input end of the device, shown on the left in FIGS. 1 and 2 to catch any cans that may bounce as they drop onto the belt through a guide, not shown. The guide is generally, a cylinder into which the cans fall or are dropped and which is so constructed and configured as to orient the cans and bottles on the belt. The cans can be of any shape, i.e. empty and of normal configuration, full, partially crushed or crushed into pucks. All will be separated according to steel or aluminum. Bottles, if dropped into the machine sort with steel cans.

Referring momentarily to FIG. 1, a plurality of cans C are shown on the continuous belt which, in use, is revolving such that the top portion travels from left to right as the device is depicted in the drawing.

Also referring to FIG. 1, the invention may comprise starter means for starting the device when a can is dropped or placed on the belt. A photocell 200 and associated circuitry connected to the computer and a light source 202 and associated circuitry may, for example, be used to detect the presence of a can or of cans and, in association with the computer, turn the sorter on until the cans are gone or for a period of time. Other detector systems, e.g. induction detectors, etc. may also be used.

Referring now to FIG. 2, some further constructional features are described. The pulley 108 may be of several shapes and sizes. In a typical embodiment, the pulley 108 has circular flanges at each end of the belt receiving surface to guide the belt, thereby providing additional stability. The pulley 108 may comprise or be mounted on a shaft 120 which is driven by any convenient drive means, an electric motor 122 being deplete&. The pulley 110 is maybe similar to or different from pulley 108 but, in the exemplary embodiment, is driven only by the continuous belt and is otherwise freewheeling. The pulley 110 may also comprise a shaft 132 which may be mounted in bearings 134 and 136. These bearings are preferably adjustable longitudinally, i.e. left or right as the device is depicted in FIGS. 1 and 2, to provide proper tension and to guide the continuous belt. Heavy duty bearings, shafts, etc. are preferred to provide a very reliable machine.

Referring again to FIGS. 1 and 2, an air blower 140 and a power source such as an electric motor 142 are provided for the air blower. Blade fans may be used but heavy duty squirrel cage type air blowers are preferred. Air from the blower exits the blower through a grill or screen 144 and flows across the width of the continuous belt over the area of the belt 106 that overlays the magnets 114.

Making reference now to FIG. 2, in particular, the mode of operation will be apparent. Cans C, and bottles if dropped on the belt 106 are carried by the belt, to the right as depicted, toward the exit end of the separator. As the cans pass in front of the air source, blower 140 and its motor 142 and grill or screen 144, aluminum cans AlC are blown off the belt, toward the bottom of the page as depicted in FIG. 2. Since the steel cans SC are attracted by the magnets, the are not blown off with the aluminum cans. Glass bottles have a much higher density, hence higher inertia, and remain on the belt to the exit end of the separator. At the exit end of the separator, the magnets have little or no attraction for the steel cans and both the steel cans and bottles drop off the end of the continuous belt assembly and are received in an appropriate receptacle.

While counting the aluminum cans is not a necessary part of the separator mechanism, it plays an important roll. As depicted in FIG. 2, the aluminum cans AlC fall through an induction coil 150, mounted to assure that all cans fly or fall through the coil by means of a bracket 152. The inductance of the coil changes when an aluminum can is enters the region of the coil and passes through it. This creates an electrical pulse for each can. The electrical pulse is transmitted by a conductor 22 to the computer. The computer registers the number of pulses and dispenses coins, certificates or coupons in the proper amount to the consumer.

An important operational feature of the invention is described with particular reference to FIG. 3. First, it is noted that the separator devices depicted in FIGS. 1 and 2 are shown horizontally to permit more clear illustrations of the device; however, it has been found to be important, for maximum reliability, to tilt the entire separator assembly as shown in FIG. 3. As shown in FIG. 2, the cans and bottles migrate to the side of the conveyer belt that is closest to the air source 140. This applies the forced air stream most directly on the cans and bottles and provides the greatest separation reliability. The separator assembly can be tilted to urge the cans and bottles toward the air source side of the belt by any desired construction, a simple bracket 160, having a portion tilted from vertical 162 and a mounting base 164 are depicted for simplicity.

The angle of tilt is not quantitatively critical; indeed, a proper balance between angle of tilt, conveyer velocity and air flow volume and air velocity can be achieved by simple experimentation. Generally, however, the angle of tilt, a, between a line PL, that is perpendicular to the surface to the belt, from the vertical, indicated by vertical line VL in FIG. 3, is typically from about 5 degrees to about 20 degrees. Obviously, other angular mensuration notation may be used, but it is sufficient to describe the continuous conveyer belt as being oriented side-to-side at an angle of from about 5 degrees to about 20 degrees from horizontal in the direction of the air flow source to cause the cans to be carried closely proximate the air flow source output, as distinct from on the side of the belt distal to the air flow source.

One final element of the invention is highly advantageous, though probably not essential. Referring to FIG. 1, it will be seen that a riser 107 is formed on the continuous belt 106. This may be added to the belt or simply formed by overlapping the ends of the belt and securing the overlapped ends together. The riser 107 forces any can or bottle that may get lodged on the belt to the exit end and off the belt with each revolution of the belt.

The separator can be made very compact. The construction of a fully functional prototype establishes that the entire separator device can be less than three feet from input end to exit end. Prototypes have been very reliable, essentially free of maintenance and operational problems.

The result of this invention is to provide a system for compensating a consumer recycler immediately for aluminum cans and separating the aluminum for sale by the recycling company. This is a significant advance over all know prior art in this very crowded art.

INDUSTRIAL APPLICATION in merchandising.

What is claimed is:

1. A compact aluminum can separator comprising, in combination:

a continuous conveyer belt;

means mounting the conveyer belt to have an upper layer and a lower layer and for revolving said belt to cause the upper layer to travel generally horizontally from an input end of the separator to an output end of the separator;

means for positioning cans and bottles on the belt proximate the input end of the separator;

forced air means constructed and configured to cause a high velocity stream of air to move above the belt from side to side of the belt transfers to the length of the conveyer belt for blowing aluminum cans from the belt;

magnets positioned adjacent the belt proximate the forced air means for preventing steel cans from being blown from the belt.

2. The invention of claim 1 further comprising riser means on the conveyer belt for clearing the separator of lodged cans or bottles.

3. The invention of claim 2 further comprising an induction metal detector for counting the number of aluminum cans sorted.

4. The invention of claim 1 further comprising an induction metal detector for counting the number of aluminum cans sorted.

5. A compact aluminum can separator comprising, in combination:

a continuous conveyer belt;

means mounting the conveyer belt to have an upper layer and a lower layer and for revolving said belt to cause the upper layer to travel generally horizontally from an input end of the separator to an output end of the separator and for mounting the conveyer belt to orient the belt from side-to-side at an angle of from about 5 degrees to about 20 degrees from horizontal;

means for positioning cans and bottles on the belt proximate the input end of the separator;

forced air means having an outlet constructed and configured to cause a high velocity stream of air to move above the belt from side to side of the belt transfers to the length of the conveyer belt for blowing aluminum cans from the belt;

magnets positioned adjacent the belt proximate the forced air means for preventing steel cans from being blown from the belt;

the belt, mounting means and forced air means being so constructed and configured as to cause cans on the belt to move sideways on the belt toward source to cause the cans to be carried closely proximate the air flow source outlet.

6. The invention of claim 5 further comprising riser means on the conveyer belt for clearing the separator of lodged cans or bottles.

7. The invention of claim 6 further comprising an induction metal detector for counting the number of aluminum cans sorted.

8. The invention of claim 5 further comprising an induction metal detector for counting the number of aluminum cans sorted.

9. A system for recycling and separating consumer aluminum cans comprising, in combination:

receptacle means for receiving cans;

a continuous conveyer belt;

means mounting the conveyer belt to have an upper layer and a lower layer and for revolving said belt to cause the upper layer to travel generally horizontally from an input end of the separator to an output end of the separator and for mounting the conveyer belt to orient the belt from side-to-side at an angle of from about 5 degrees to about 20 degrees from horizontal;

means for positioning cans and bottles on the belt proximate the input end of the separator;

forced air means having an outlet constructed and configured to cause a high velocity stream of air to move above the belt from side to side of the belt transfers to the length of the conveyer belt for blowing aluminum cans from the belt;

magnets positioned adjacent the belt proximate the forced air means for preventing steel cans from being blown from the belt;

the belt, mounting means and forced air means being so constructed and configured as to cause cans on the belt to move sideways on the belt toward source to cause the cans to be carried closely proximate the air flow source outlet;

means for generating an electrical signal in response to each aluminum can deposited in the receptacle; and means for receiving said signal for dispensing coins or certificates or coupons to the consumer in response to the number of aluminum cans deposited.

* * * * *